US008585350B1

(12) United States Patent
Liang

(10) Patent No.: US 8,585,350 B1
(45) Date of Patent: Nov. 19, 2013

(54) TURBINE VANE WITH TRAILING EDGE EXTENSION

(76) Inventor: George Liang, Palm City, FL (US)

( * ) Notice: Subject to any disclaimer, the term of this patent is extended or adjusted under 35 U.S.C. 154(b) by 299 days.

(21) Appl. No.: 13/005,836

(22) Filed: Jan. 13, 2011

(51) Int. Cl.
*F01D 9/02* (2006.01)
*F01D 25/08* (2006.01)

(52) U.S. Cl.
USPC ..... 415/115

(58) Field of Classification Search
USPC .... 415/115, 116; 416/97 R, 96 R, 96 A, 97 A
See application file for complete search history.

(56) References Cited

U.S. PATENT DOCUMENTS 3,528,751 A * 9/1970 Davis et al. ..... 415/115
6,422,819 B1 * 7/2002 Tsai et al. ..... 416/97 R
6,514,037 B1 * 2/2003 Danowski et al. ..... 415/115
7,097,417 B2 * 8/2006 Liang ..... 415/115
7,597,536 B1 * 10/2009 Liang ..... 415/138
2003/0138322 A1 * 7/2003 Boury et al. ..... 416/97 R
2004/0253106 A1 * 12/2004 Self et al. ..... 416/97 R
2007/0189898 A1 * 8/2007 Hooper et al. ..... 416/97 R
2008/0101935 A1 * 5/2008 Clouse et al. ..... 416/193 A

* cited by examiner

*Primary Examiner* — Nathaniel Wiehe
*Assistant Examiner* — Wayne A Lambert
(74) *Attorney, Agent, or Firm* — John Ryznic

(57) ABSTRACT

A turbine vane with an airfoil extending between an inner diameter endwall and an outer diameter endwall, where thin slots are formed between the airfoil and the endwall in the trailing edge section in which cooling air is supplied to produce impingement cooling and purge air to prevent hot gas flow across the slots. The thin slot functions to thermally de-couple the thin airfoil trailing edge section from the thick endwall to prevent cracks.

6 Claims, 3 Drawing Sheets

TURBINE VANE WITH TRAILING EDGE EXTENSION

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a turbine stator vane with a trailing edge to endwall construction and cooling.

2. Description of the Related Art including information disclosed under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The trailing edge section of an airfoil is very thin compared to other sections. In a large frame heavy duty industrial engine stator vane, the airfoil extends between an outer diameter endwall and an inner diameter endwall. A fillet forms a transition from the airfoil to the endwall. The trailing edge section of the airfoil is much more difficult to provide cooling than the immediate surfaces of the endwall due to the thin section of the airfoil. It is very difficult to provide for cooling passages within this very thin airfoil section. Thus, cracks occur due to the thermal stresses induced by the temperature differences between the vane airfoil trailing edge thin corner and the relatively thick endwall. This crack formation is especially pronounced in vane segments having two airfoils per segment because of circumferential distortion and axial bow of the endwall that produces additional loading at the vane trailing edge and endwall transition location.

FIG. 1 shows a prior art turbine stator vane with two airfoils 11 formed in a segment between an outer diameter (OD) endwall 14 and an inner diameter (ID) endwall 15 with a fillet 12 forming a smooth transition between the airfoil and the respective endwall. The ID endwall 15 includes a front rail 17 and an aft rail 16 extending from the bottom end with a seal slot 18 on the ends to receive a seal between adjacent vane endwalls. Drilling cooling holes at the vane trailing edge section to provide convection cooling will produce unacceptable stress levels around the cooling holes, especially at the highly loaded locations.

BRIEF SUMMARY OF THE INVENTION

A turbine stator vane, especially a turbine vane for a large frame heavy duty industrial gas turbine engine, where the vane includes an airfoil with a thin trailing edge section extending from an endwall, and the airfoil trailing edge includes an extension that forms a thin slot between the airfoil and the endwall to thermally decouple the thin airfoil trailing edge from the endwall surface. The thin slot is formed at both the outer diameter and inner diameter endwalls and both thin slots are supplied with cooling air to provide cooling and to seal against hot gas leakage flow across the thin slot.

DETAILED DESCRIPTION OF THE INVENTION

Figure 1:
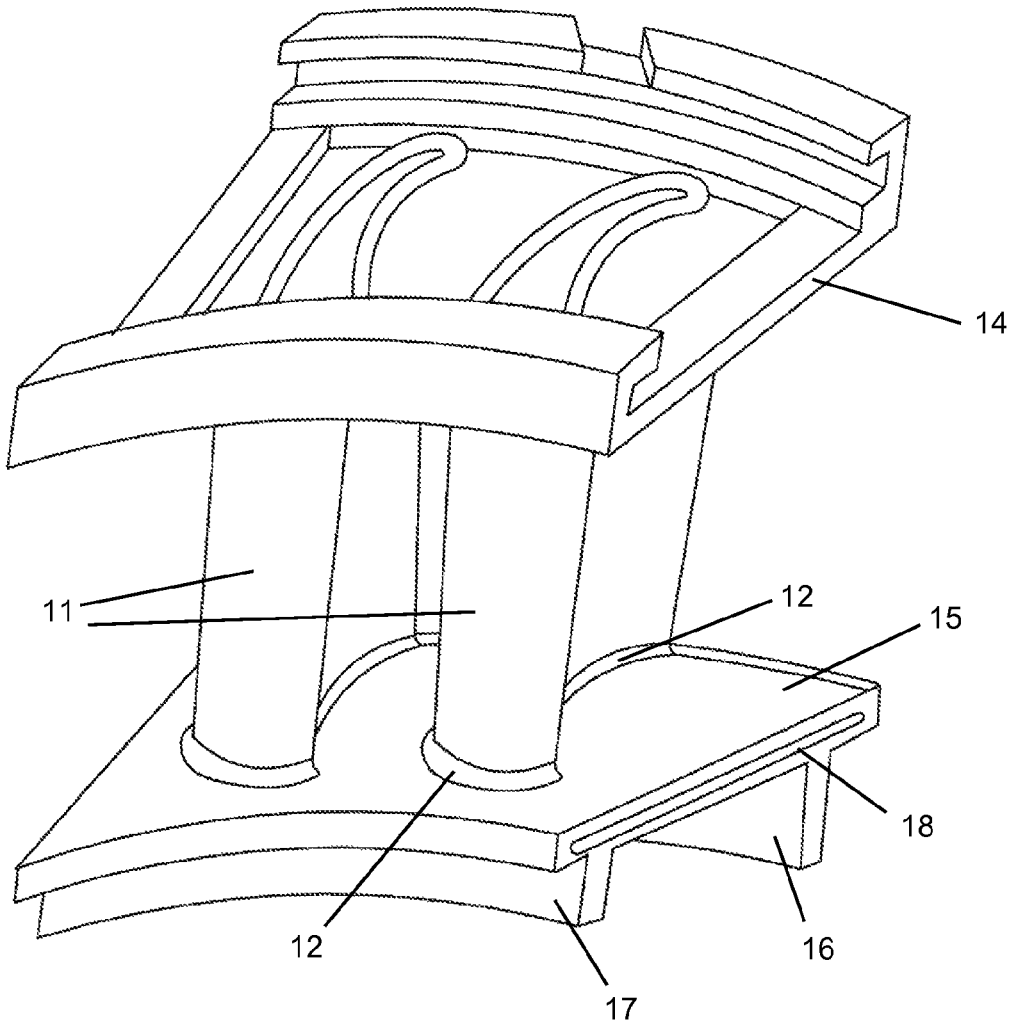
Fig 1 Prior Art
FIG. 1 shows a prior art turbine stator vane assembly with two airfoils extending between endwalls with a view from the leading edge side.
Figure 2:
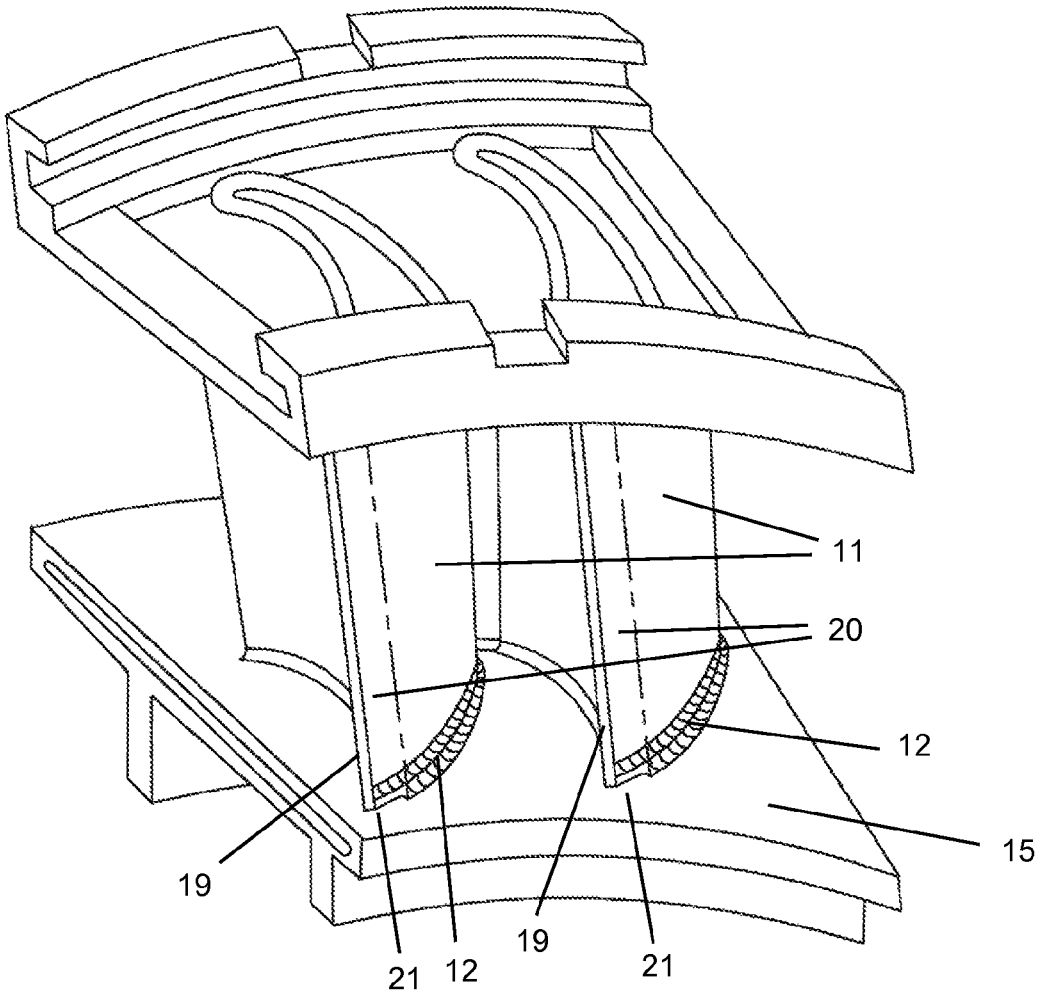
FIG. 2 shows a turbine vane assembly of the present invention from a view along the trailing edge side with a thin slot formed between the airfoil and the inner diameter endwall.

The turbine stator vane of the present invention is intended for use in a large frame heavy duty industrial gas turbine (IGT) engine, but can be used in smaller IGT engines or aero engines. FIG. 2 shows a turbine stator vane assembly of the present invention with two airfoils 11 extending between an OD endwall and an ID endwall 15. Because of the twin airfoil vane assembly (two airfoils for each segment), the thin slots 21 formed between the airfoil in the trailing edge section and the endwalls is especially useful. The airfoil trailing edges 19 are seen in FIG. 2 with a fillet 12 forming a transition to the two endwalls. The last section of the airfoil in the trailing edge section is removed to form a thin slot 21 between the airfoil and the endwall. The thin slot 21 will decouple the airfoil from the endwall in the trailing edge section where the airfoil is the thinnest in order to prevent the cracks due to the thermal temperature differences as described above. In FIG. 2, an airfoil trailing edge extension 20 is formed and seen in FIG. 2 as the section of the airfoil downstream from the dashed line extending from the OD thin slot 21 to the ID thin slot 21.

Figure 3:
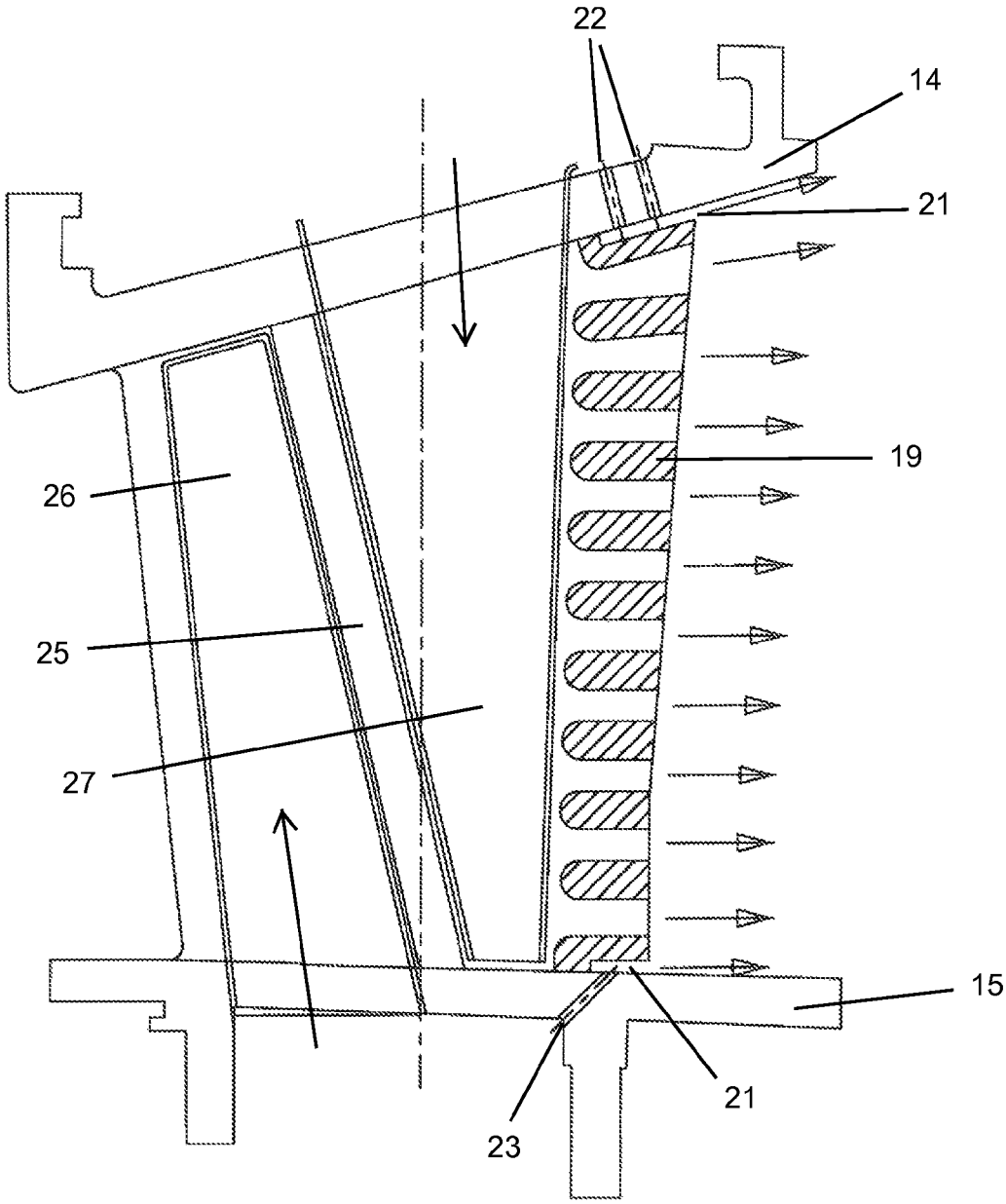
FIG. 3 shows a cross section side view of the vane of the present invention with the thin slots and a cooling flow arrangement.

FIG. 3 shows a cross section view of the vane with the thin slots 21 formed at both the OD endwall 14 and the ID endwall 15. Cooling holes 22 supply cooling air from the OD cooling air supply cavity located above the OD endwall and to the OD thin slot 21. A cooling hole 23 is also located in the ID endwall 15 to supply cooling air from the ID cooling air supply cavity located below the ID endwall and into the thin slot 21. The vane can include a partition rib 25 that separates a leading edge insert tube 26 and a trailing edge insert tube 27 each having an arrangement of impingement holes to direct impingement cooling air to various surfaces inside the vane airfoil for cooling.

The thin slot cooling holes 22 provide backside impingement cooling to the underside of the thin airfoil section along the trailing edges and purge any hot gas leakage from flowing across the thin slots from one side of the airfoil to the opposite side. The cooling air from the thin slot is then discharged into the hot gas stream.

The thin slots 21 function to remove all of the airfoil material from the endwall surface to a top surface of the thin slot between the pressure side wall and the suction side wall of the airfoil at this trailing edge location. This is formed at both the ID and OD endwalls 15 and 14. The thin slots 21 function to thermally de-couple the vane trailing edge corners from the endwalls which lowers the vane trailing edge corner thin section thermal gradient as well as the stiffness of the trailing edge root section, and therefore increase a flexibility for the vane trailing edge root section and lower the thermally induced strain. This results in a lower thermal stress and strain range for the airfoil extension section (part of the airfoil that extends beyond the thin slots), alleviate the crack initiation at the airfoil trailing edge corner and allow a longer overall vane operating life.

I claim the following:

1. A turbine stator vane comprising:

an airfoil extending between an outer diameter endwall and an inner diameter endwall;

a row of exit holes located in a trailing edge section of the airfoil;

a fillet forming a transition from the airfoil to the outer diameter and inner diameter endwalls;

a thin slot formed between the airfoil and the inner diameter endwall and the outer diameter endwall such that an extension of the airfoil in the trailing edge section is formed;

the thin slot each formed by surfaces parallel to a surface of the endwall; and, a cooling hole opening into each of the thin slots to discharge cooling air into the thin slots.

2. The turbine stator vane of claim 1, and further comprising:

the cooling holes are impingement cooling holes directed to discharge impingement cooling air onto a surface of the airfoil that forms the thin slot.

3. The turbine stator vane of claim 1, and further comprising:

each of the thin slots extend from a pressure side surface to a suction side surface of the airfoil.

4. A turbine stator vane comprising:

an airfoil extending between an outer diameter endwall and an inner diameter endwall;

the airfoil having a trailing edge region with a row of exit holes to discharge cooling air from the airfoil;

an outer diameter endwall thin slot formed between an upper surface of the trailing edge region of the airfoil and the outer diameter endwall;

an inner diameter endwall thin slot formed between a lower surface of the trailing edge region of the airfoil and the inner diameter endwall;

an outer endwall cooling air hole opening into the outer diameter endwall thin slot directed to direct impingement cooling air to the upper surface of the trailing edge region of the airfoil; and, an inner endwall cooling air hole opening into the inner diameter endwall thin slot directed to direct impingement cooling air to the inner surface of the trailing edge region of the airfoil.

5. The turbine stator vane of claim 4, and further comprising:

the inner and outer diameter endwall thin slots extend from a pressure side surface to a suction side surface of the airfoil.

6. The turbine stator vane of claim 4, and further comprising:

the inner and outer diameter endwall thin slots thermally de-couple trailing edge corners of the vane from the two endwalls.

* * * * *